US007178684B1

(12) United States Patent
Budden et al.

(10) Patent No.: US 7,178,684 B1
(45) Date of Patent: Feb. 20, 2007

(54) HOURGLASS-SHAPED HOT-FILL CONTAINER AND METHOD OF MANUFACTURE

(75) Inventors: Todd M. Budden, Maumee, OH (US); Charles P. Simpson, Jr., Adrian, MI (US); Dennis A. Rogers, Maumee, OH (US)

(73) Assignee: Graham Packaging PET Technologies Inc., York, PA (US)

( * ) Notice: Subject to any disclaimer, the term of this patent is extended or adjusted under 35 U.S.C. 154(b) by 161 days.

(21) Appl. No.: 10/893,080

(22) Filed: Jul. 16, 2004

(51) Int. Cl.
*B65D 1/02* (2006.01)
*B65D 1/40* (2006.01)

(52) U.S. Cl. ..... 215/381; 215/383; 215/384; 229/669; 229/675

(58) Field of Classification Search ..... 215/381, 215/384, 398, 900; 220/666, 675, 771, 907
See application file for complete search history.

(56) References Cited

U.S. PATENT DOCUMENTS

| | | | | |
|---|---|---|---|---|
| 3,537,498 | A | 11/1970 | Amand et al. | |
| 3,871,541 | A | 3/1975 | Adomaitis | |
| D259,096 | S | 5/1981 | Dittmeyer | |
| 4,375,442 | A | 3/1983 | Ota et al. | |
| 4,379,099 | A | 4/1983 | Ota et al. | |
| 4,497,855 | A | 2/1985 | Agrawal et al. | |
| D304,683 | S | 11/1989 | Hofer | |
| D315,678 | S | 3/1991 | Darr | |
| 5,224,614 | A | 7/1993 | Bono et al. | |
| D346,556 | S * | 5/1994 | Sirico et al. | D9/538 |
| 5,732,838 | A | 3/1998 | Young | |
| D393,208 | S * | 4/1998 | Wilson et al. | D9/538 |
| 5,971,184 | A * | 10/1999 | Krishnakumar et al. | 215/384 |
| 6,112,925 | A * | 9/2000 | Nahill et al. | 215/382 |
| D449,000 | S * | 10/2001 | Brown, III | D9/538 |
| D453,112 | S * | 1/2002 | Macky et al. | D9/538 |
| 6,413,466 | B1 * | 7/2002 | Boyd et al. | 264/523 |
| D466,813 | S | 12/2002 | Thierjung et al. | |
| D469,696 | S | 2/2003 | Bryant et al. | |
| D470,773 | S | 2/2003 | Darr et al. | |
| 6,520,362 | B2 | 2/2003 | Heisel et al. | |
| D476,236 | S | 6/2003 | Ungrady et al. | |
| 6,763,969 | B1 * | 7/2004 | Melrose et al. | 220/669 |
| D504,069 | S * | 4/2005 | Gross et al. | D9/538 |
| 2001/0022291 | A1 * | 9/2001 | Shimada et al. | 215/382 |
| 2002/0008077 | A1 | 1/2002 | Lane et al. | |
| 2002/0017502 | A1 | 2/2002 | Renz | |
| 2002/0070193 | A1 | 6/2002 | Mero | |
| 2003/0121881 | A1 | 7/2003 | Higuchi | |
| 2005/0121408 | A1 * | 6/2005 | Deemer et al. | 215/381 |

* cited by examiner

*Primary Examiner*—Sue A. Weaver
(74) *Attorney, Agent, or Firm*—Venable LLP; James R. Burdett; Stuart I. Smith

(57) ABSTRACT

A hot-fill container is of one-piece plastic construction that includes a base, a sidewall extending from the base, a dome connected to the sidewall and a neck finish extending from the dome. The sidewall has an hourglass shape as viewed in side elevation with ends connected to the base and the dome. The sidewall includes a circumferential series of vacuum panels that are flexible inwardly with respect to the remainder of the sidewall. The vacuum panels preferably are rectangular as viewed in side elevation and concave as viewed tangentially of the container.

12 Claims, 2 Drawing Sheets

HOURGLASS-SHAPED HOT-FILL CONTAINER AND METHOD OF MANUFACTURE

The present invention is directed to a plastic container and method of manufacture that is particularly adapted for hot-fill applications.

BACKGROUND AND SUMMARY OF THE INVENTION

In so-called hot-fill packages, a container is filled with hot fluid product and capped while the fluid product is still hot. As the fluid product cools, a reduction in fluid volume creates a vacuum within the package—i.e., an internal pressure that is less than the surrounding atmospheric pressure. An object of the present invention is to provide a molded plastic container that is particularly adapted for hot-fill applications and is contoured for easy handling such as by a small child.

A hot-fill container in accordance with one aspect of the present invention is of one-piece plastic construction that includes a base, a sidewall extending from the base, a dome connected to the sidewall and a neck finish extending from the dome. The sidewall has an hourglass shape as viewed in side elevation with ends connected to the base and the dome. The sidewall includes a circumferential series of vacuum panels that are flexible inwardly with respect to the remainder of the sidewall. The vacuum panels preferably are rectangular as viewed in side elevation and concave as viewed tangentially of the container.

A plastic hot-fill container in accordance with another aspect of the present invention includes a base, a sidewall extending from the base, a dome connected to the sidewall and a neck finish extending from the dome. The neck finish, the dome, the sidewall and the base are coaxial, and the dome and base are circular in plan view. The sidewall includes a series of circumferentially spaced axially extending ribs having outer surfaces on an hourglass-shaped surface of revolution around the axis of the container, and a circumferential series of vacuum panels that are flexibly connected to the ribs. The vacuum panels are rectangular as viewed in side elevation, are concave as viewed tangentially of the container axis, and are radially inset from the ribs. The base and the dome have maximum diameters, which preferably are equal, and the sidewall is recessed radially inwardly from such maximum diameters. A pair of circumferential channels preferably connect respective ends of the sidewall to the base and the dome.

BRIEF DESCRIPTION OF THE DRAWINGS

The invention, together with additional objects, features, advantages and aspects thereof, will best be understood from the following description, the appended claims and the accompanying drawings, in which:

DETAILED DESCRIPTION OF PREFERRED EMBODIMENTS

Figure 1:
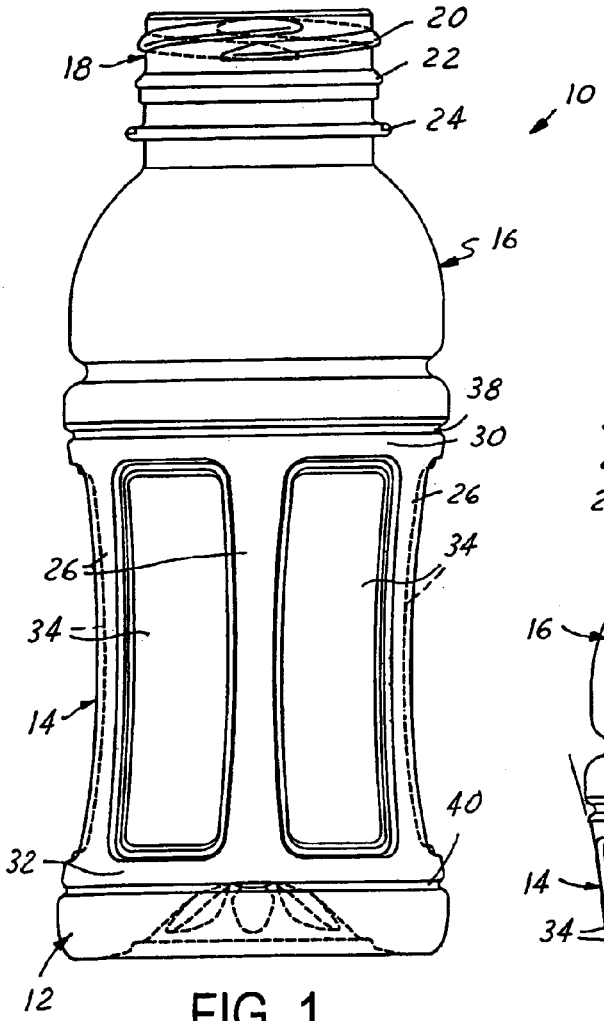
FIG. 1 is a front elevational view of a container in accordance with one presently preferred embodiment of the invention.
Figure 2:
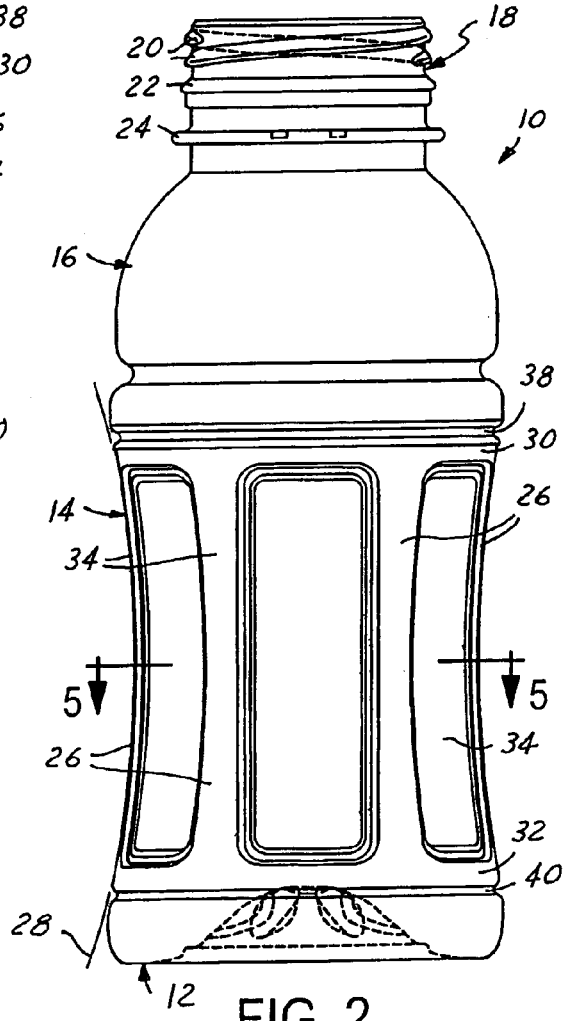
FIG. 2 is a side elevational view of the container illustrated in FIG. 1.
Figure 3:
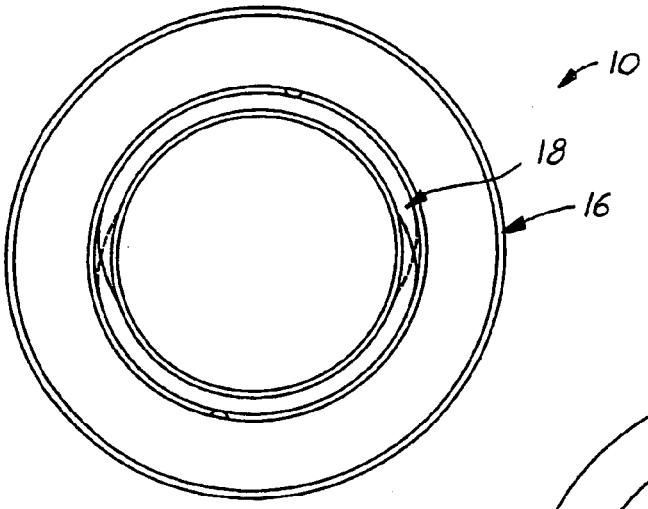
FIG. 3 is a top plan view of the container illustrated in FIGS. 1 and 2.
Figure 4:
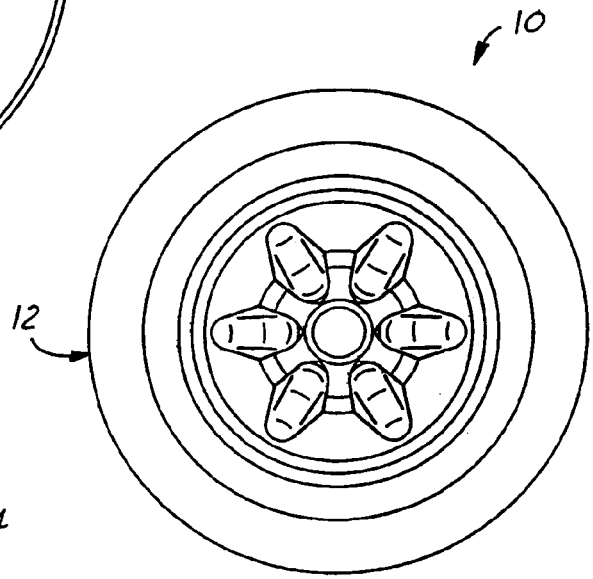
FIG. 4 is a bottom view of the container illustrated in FIGS. 1 and 2.

The drawings illustrate a container 10 in accordance with one presently preferred embodiment of the invention. Container 10 preferably is of integrally blow-molded unitary or one-piece plastic construction, and includes a base 12, a sidewall 14 extending from base 12, a dome 16 extending from sidewall 14 and a neck finish 18 extending from dome 16. Base 12, sidewall 14, dome 16 and neck finish 18 preferably are coaxial with each other on a common central axis of container 10. As best seen in FIGS. 3 and 4, neck finish 18, dome 16 and base 12 are circular in geometry as viewed from the axial or plan direction. FIGS. 1 and 2 illustrate an exemplary but presently preferred configuration of neck finish 18 as including a pair of thread segments 20, a tamper bead 22 and a support flange 24. Other neck finish configurations can be employed. Likewise, the illustrated geometries of dome 16 and base 12 are merely exemplary, albeit preferred. Container 10 can be fabricated using any suitable manufacturing technique, preferably by reheat blow molding a container preform. The plastic composition of container 10 can be of monolayer or multilayer construction, with one presently preferred construction being of monolayer polyethylene terephthalate (PET).

Figure 5:
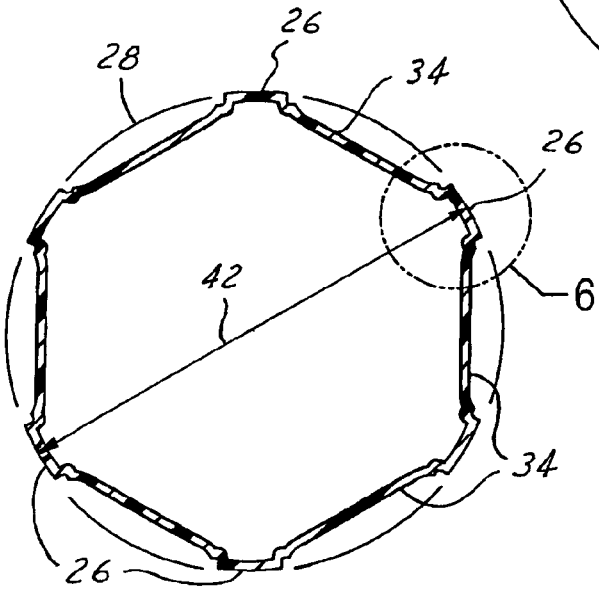
FIG. 5 is a cross sectional view taken substantially along the line 5—5 in FIG. 2.
Figure 6:
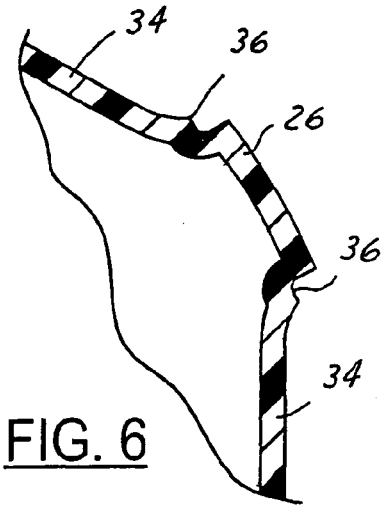
FIG. 6 is a fragmentary sectional view on an enlarged scale of the portion of FIG. 5 within the area 6.

Container sidewall 16 includes a circumferential series of ribs 26 that preferably are equally spaced from each other circumferentially around sidewall 14. Ribs 26 have outer surfaces that lie a common hourglass-shaped surface of revolution 28 (FIGS. 2 and 5). Ribs 26 preferably extend in the axial direction (i.e., each has a centerline that is coplanar with the container axis), and are interconnected at their upper and lower ends by the circumferentially extending bands 30,32. (Directional words such as "upper" and "lower" are employed by way of description and not limitation with respect to the upright orientation of the container illustrated in FIGS. 1 and 2. Directional words such as "axial" and "radial" are employed by way of description and not limitation with respect to the central axis of neck finish 18, which preferably is also the central axis of container 10 as previously indicated.) A circumferential series of vacuum panels 34 are disposed between ribs 26. The term "vacuum panel" is employed in its usual sense to refer to a container wall section that is flexibly connected to adjacent wall sections—e.g., ribs 26—so that panels 34 can flex inwardly substantially independently of ribs 26 and bands 30, 32. Vacuum panels 34 are rectangular as viewed in side elevation (FIG. 2) and concave as viewed tangentially of the container axis (FIG. 1). Each panel 34 is connected to adjacent ribs 26 and bands 30,32 by a hinge structure 36, best seen in FIG. 6, that extends entirely around each panel. Bands 30, 32 at the upper and lower ends of sidewall 14 are connected to dome 16 and base 12 by the respective inwardly recessed channels 38,40.

Dome 16 has a maximum diameter in the preferred embodiment of the invention immediately adjacent to channel 38, and base 12 preferably has a maximum diameter immediately adjacent to channel 40. In the illustrated embodiment of the invention, these maximum diameters are substantially equal. Sidewall 14 is recessed radially inwardly from these maximum diameters. In a currently preferred embodiment of the invention for holding eight ounces of liquid, the maximum diameters of dome 16 and base 14 are 2.338 inches, and the axial height of sidewall 14 is 2.818 inches. The overall height of the container is 5.813 inches, and neck finish 18 is a 38 mm finish. The minimum diameter 42 (FIG. 5) across sidewall ribs 26, which occurs at the axial mid point of the sidewall, is 2.045 inches in this exemplary embodiment of the invention. Thus, the container can be readily grasped by small children. When the container is filled with hot liquid capped, vacuum panels 34 flex radially inwardly to absorb the vacuum pressure, while the remainder of the container, including sidewall ribs 26 and bands 30, 32, does not experience substantial flexure.

There thus have been disclosed a hot-fill plastic container and method of manufacture that fully satisfy all of the objects and aims previously set forth. The invention has been disclosed in conjunction with one presently preferred embodiment thereof, and a number of modifications and variations have been described. Other modifications and variations will readily suggest themselves to persons of ordinary skill in the art in view of the foregoing discussion. The invention is intended to embrace all such modifications and variations as fall within the spirit and broad scope of the appended claims.

The invention claimed is:

1. A hot-fill container of one-piece plastic construction comprising:

a base;

a sidewall extending from said base;

a dome extending from said sidewall; and a neck finish extending from said dome, wherein said sidewall has an hourglass shape as viewed in side elevation, front elevation, and rear elevation, with ends connected to said base and said dome, said sidewall includes a circumferential series of vacuum panels that are flexible inwardly with respect to the remainder of said sidewall, said sidewall includes a series of circumferentially spaced axially extending ribs that define said hourglass shape before and after vacuum take-up, and said vacuum panels are inset from said ribs.

2. The container set forth in claim 1 wherein said vacuum panels are rectangular as viewed in side elevation and concave as viewed tangentially of said sidewall.

3. The container set forth in claim 2 wherein said base and said dome are circular in plan view.

4. The container set forth in claim 3 including a pair of circumferential channels connecting respective ends of said sidewall to said base and said dome.

5. The container set forth in claim 3 wherein said base and said dome have maximum diameters, and said sidewall is recessed inwardly from said maximum diameters.

6. The container set forth in claim 5 wherein said maximum diameters are equal.

7. A plastic hot-fill container that comprising:

a base;

a sidewall extending from said base;

a dome extending from said sidewall; and a neck finish extending from said dome, wherein said neck finish, said dome, said sidewall and said base are coaxial, dome and said base are circular in plan view, said sidewall includes a series of circumferentially spaced axially extending ribs having outer surfaces on an hourglass-shaped surface of revolution around said axis after vacuum take-up, and a circumferential series of vacuum panels that are-flexibly connected to said ribs, said vacuum panels being rectangular as viewed in side elevation, concave as viewed tangentially of said axis, and being radially inset from said ribs.

8. The container set forth in claim 7 wherein said base and said dome have maximum diameters, and said sidewall is recessed inwardly from said maximum diameters.

9. The container set forth in claim 8 wherein said maximum diameters are equal.

10. The container set forth in claim 8 including a pair of circumferential channels connecting respective ends of said sidewall to said base and said dome.

11. A method of making a hot-fill container, the method comprising blow molding a container of one-piece plastic construction that includes:

a base;

a sidewall extending from said base;

a dome extending from said sidewall; and a neck finish extending from said dome, wherein said sidewall has an hourglass shape as viewed in side elevation, front elevation, and rear elevation, with ends connected to said base and said dome, said sidewall includes a circumferential series of vacuum panels that are flexible inwardly with respect to the remainder of said sidewall, said sidewall includes a series of circumferentially spaced axially extending ribs that define said hourglass shape before and after vacuum take-up, and said vacuum panels are inset from said ribs.

12. The method set forth in claim 11 wherein the step of providing further includes providing said vacuum panels with a rectangular shape as viewed in side elevation and a concave shape as viewed tangentially of said sidewall.

* * * * *